US011651888B2

(12) United States Patent
Igarashi et al.

(10) Patent No.: US 11,651,888 B2
(45) Date of Patent: May 16, 2023

(54) COIL COMPONENT

(71) Applicant: Murata Manufacturing Co., Ltd., Kyoto-fu (JP)

(72) Inventors: Akio Igarashi, Nagaokakyo (JP); Kazuhiko Takenaka, Nagaokakyo (JP); Shigeto Yamamoto, Nagaokakyo (JP); Ryota Hashimoto, Nagaokakyo (JP); Yuki Kanbe, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 1142 days.

(21) Appl. No.: 16/264,404

(22) Filed: Jan. 31, 2019

(65) Prior Publication Data

US 2019/0244748 A1 Aug. 8, 2019

(30) Foreign Application Priority Data

Feb. 5, 2018 (JP) ..... JP2018-018569
Oct. 19, 2018 (JP) ..... JP2018-197276

(51) Int. Cl.
*H01F 27/29* (2006.01)
*H01F 17/04* (2006.01)
(Continued)

(52) U.S. Cl.
CPC ..... *H01F 27/29* (2013.01); *H01F 17/04* (2013.01); *H01F 17/045* (2013.01); *H01F 27/2823* (2013.01); *H01F 27/292* (2013.01); *H01F 41/02* (2013.01); *H01F 3/10* (2013.01); *H01F 2017/0093* (2013.01)

(58) Field of Classification Search
CPC ..... H01F 27/29; H01F 17/04; H01F 17/045; H01F 27/2823
See application file for complete search history.

(56) References Cited

U.S. PATENT DOCUMENTS

2015/0042436 A1* 2/2015 Arimitsu ..... H01F 17/045 336/192
2016/0133377 A1* 5/2016 Takagi ..... H01F 27/29 29/605
(Continued)

FOREIGN PATENT DOCUMENTS

JP 07201580 A * 8/1995
JP 2006-004989 A 1/2006
(Continued)

*Primary Examiner* — Mang Tin Bik Lian
*Assistant Examiner* — Malcolm Barnes
(74) *Attorney, Agent, or Firm* — Studebaker & Brackett PC

(57) ABSTRACT

A flange portion includes a projecting surface that is positioned in a leading end of a projection projecting toward a mounting substrate and that faces the mounting substrate, and a principal surface that extends in a direction crossing the projecting surface and that faces a direction in which the pair of flange portions are aligned. A metal terminal includes a mounting portion opposed to the projecting surface and an end surface portion opposed to the principal surface. An angle θ between the mounting portion and the end surface portion satisfies the relationship 85 degrees≤θ<90 degrees. The angle θ between the mounting portion and the end surface portion is smaller than an angle θ1 between the projecting surface and the principal surface.

22 Claims, 3 Drawing Sheets

(51) Int. Cl.

| | |
|---|---|
| ***H01F 27/28*** | (2006.01) |
| ***H01F 17/00*** | (2006.01) |
| ***H01F 41/02*** | (2006.01) |
| *H01F 3/10* | (2006.01) |

(56) References Cited

U.S. PATENT DOCUMENTS

| | | | | |
|---|---|---|---|---|
| 2016/0365191 | A1* | 12/2016 | Horie | H01F 27/2823 |
| 2017/0025212 | A1* | 1/2017 | Jerez | H01F 41/07 |
| 2017/0301455 | A1* | 10/2017 | Kobayashi | H01F 27/2823 |
| 2017/0365399 | A1* | 12/2017 | Kobayashi | H01F 27/292 |
| 2018/0130597 | A1* | 5/2018 | Komaya | H01F 17/045 |

FOREIGN PATENT DOCUMENTS

| | | | | |
|---|---|---|---|---|
| JP | 2006-245044 | A | | 9/2006 |
| JP | 2007-088405 | A | | 4/2007 |
| JP | 2007088405 | A | * | 4/2007 |
| JP | 2009158777 | A | * | 7/2009 |
| JP | 2012174815 | A | * | 9/2012 |
| JP | 2015-035473 | A | | 2/2015 |
| JP | 2017-005079 | A | | 1/2017 |

* cited by examiner

COIL COMPONENT

CROSS-REFERENCE TO RELATED APPLICATIONS

This application claims benefit of priority to Japanese Patent Application No. 2018-018569, filed Feb. 5, 2018, and to Japanese Patent Application No. 2018-197276, filed Oct. 19, 2018, the entire content of each is incorporated herein by reference.

BACKGROUND

Technical Field

The present disclosure relates to coil components.

Background Art

One known coil component is a common-mode choke coil in which a pair of wires are wound around a winding core portion of a drum core, and ends of the wires are electrically connected to metal terminals on flange portions on the drum core, as described, for example, in Japanese Unexamined Patent Application Publication No. 2015-35473. Each of the metal terminals described in that Patent Document is joined to a projecting surface (mounting surface in that Patent Document) of a projection in the flange portion, the projection projecting toward a mounting substrate, the projecting surface being opposed to the mounting substrate, and is joined to an end surface of the flange portion.

The coil component of the above-described type has become smaller, and it also be used under environments where expansion and contraction are caused by temperature changes or under high-temperature environments in some cases. Thus there is a need to improve its endurance. In particular, it is desired to develop coil components in which detachment of metal terminals from flange portions can be suppressed.

SUMMARY

Accordingly, the present disclosure provides a coil component in which detachment of a metal terminal can be suppressed.

According to preferred embodiments of the present disclosure, a coil component includes a core including a winding core portion and a pair of flange portions on opposite ends of the winding core portion, a metal terminal on each of the pair of flange portions, and a wire wound around the winding core portion and including end portions electrically connected to the metal terminals. Each of the flange portions includes a projecting surface that is positioned in a leading end of a projection projecting toward a mounting substrate and that faces the mounting substrate and an end surface that extends in a direction crossing the projecting surface and that faces an opposite side to the winding core portion in a direction in which the pair of flange portions are aligned. Each of the metal terminals includes a mounting portion opposed to the projecting surface and an end surface portion opposed to the end surface, and an angle θ between the mounting portion and the end surface portion is smaller than an angle θ1 between the projecting surface and the end surface.

In this configuration, the angle θ between the mounting portion and the end surface portion of the metal terminal is smaller than the angle θ1 between the projecting surface and the end surface of the flange portion. For example, if the angle θ between the mounting portion and the end surface portion in the metal terminal is larger than the angle θ1 between the projecting surface and the end surface of the flange portion (is an obtuse angle), the end surface portion in the metal terminal and the end surface of the flange portion are partly separated from each other. This may result in a situation where the end surface portion in the metal terminal and the end surface of the flange portion are not sufficiently joined between their surfaces. To address this issue, the angle θ between the mounting portion and end surface portion in the metal terminal is smaller than the angle θ1 between the projecting surface and end surface of the flange portion. With this configuration, the situation where the end surface portion in the metal terminal and the end surface of the flange portion are not sufficiently joined between their surfaces can be suppressed, and detachment of the metal terminal from the core (flange portion) can be suppressed.

According to preferred embodiments of the present disclosure, in the above-described coil component, when the angle θ1 between the projecting surface and the end surface is about 90 degrees, the angle θ between the mounting portion and the end surface portion may satisfy a relationship 85 degrees≤θ<90 degrees. In this configuration, when the angle θ1 between the projecting surface and the end surface is about 90 degrees, the angle θ between the mounting portion and the end surface portion may satisfy the relationship 85 degrees≤θ<90 degrees. For example, if the angle θ in the metal terminal is an obtuse angle, which is larger than 90 degrees, the angle θ is larger than the angle θ1 between the projecting surface and end surface, the end surface portion in the metal terminal and the end surface of the flange portion are partly separated from each other, and this may result in a situation where the end surface portion in the metal terminal and the end surface of the flange portion are not sufficiently joined between their surfaces. To address this issue, the relationship 85 degrees≤θ<90 degrees is satisfied, as described above. Thus, the situation where the end surface portion in the metal terminal and the end surface of the flange portion are not sufficiently joined between their surfaces can be suppressed, and detachment of the metal terminal from the core (flange portion) can be suppressed.

According to preferred embodiments of the present disclosure, in the above-described coil component, the metal terminal may be joined to only the end surface of the flange portion. In this configuration, the metal terminal is joined to the end surface of the flange portion, that is, it is not joined to the projecting surface of the flange portion with an adhesive or the like. Here, if the projecting surface and the metal terminal are joined together with an adhesive or the like, the effects of expansion and contraction of the mounting substrate caused by, for example, temperature changes are large. When the metal terminal is joined to only the end surface of the flange portion, as described above, the effects of expansion and contraction of the mounting substrate caused by temperature changes can be suppressed, and detachment of the metal terminal from the core can be suppressed.

According to preferred embodiments of the present disclosure, in the above-described coil component, the metal terminal may be joined to both the end surface and the projecting surface of the flange portion, and a joined area at the projecting surface may be smaller than a joined area at the end surface. In this configuration, because the joined area at the projecting surface is smaller than the joined area at the end surface, if expansion and contraction are caused by temperature changes in the mounting substrate, the metal terminal adjacent to the projecting surface is easily separated from the projecting surface, and the joined state at the end surface can be maintained.

According to preferred embodiments of the present disclosure, in the above-described coil component, the metal terminal may be formed by bending a single plate containing copper, the metal terminal may include an opposed surface opposed to the mounting substrate, the opposed surface may being covered with a nickel metal film and a tin metal film. In this configuration, the nickel metal film can suppress corrosion of the metal terminal and can also suppress diffusion of the metal terminal (copper) by the tin metal film. In addition, the tin metal film can enhance solder wettability at the time of soldering the metal terminal and the mounting substrate.

According to preferred embodiments of the present disclosure, in the above-described coil component, the metal terminal may be made of a plate having a thickness not less than about 50 μm and not more than about 150 μm (i.e., from about 50 μm to about 150 μm). In this configuration, the thickness of the plate forming the metal terminal set at not less than about 50 μm can enable the metal terminal to have a satisfactory strength, and the thickness set at not more than about 150 μm can contribute to improved workability.

According to preferred embodiments of the present disclosure, in the above-described coil component, the metal terminal may be made of a plate having a Young's modulus not less than about 100 GPa and not more than about 200 GPa (i.e., from about 100 GPa to about 200 GPa). In this configuration, the Young's modulus of the plate forming the metal terminal set at not less than about 100 GPa can enable the metal terminal to have a satisfactory strength, and the Young's modulus set at not more than about 200 GPa can enable the metal terminal to have appropriate flexibility.

In the coil component according to preferred embodiments of the present disclosure, detachment of the metal terminal can be suppressed.

Other features, elements, characteristics and advantages of the present disclosure will become more apparent from the following detailed description of preferred embodiments of the present disclosure with reference to the attached drawings.

DETAILED DESCRIPTION

An embodiment will be described below. In accompanying drawings, for facilitating understanding, constituent elements may be magnified. The dimensional ratios of the constituent elements in a drawing may be different from the real ones or ones illustrated in other drawings.

Figure 1:
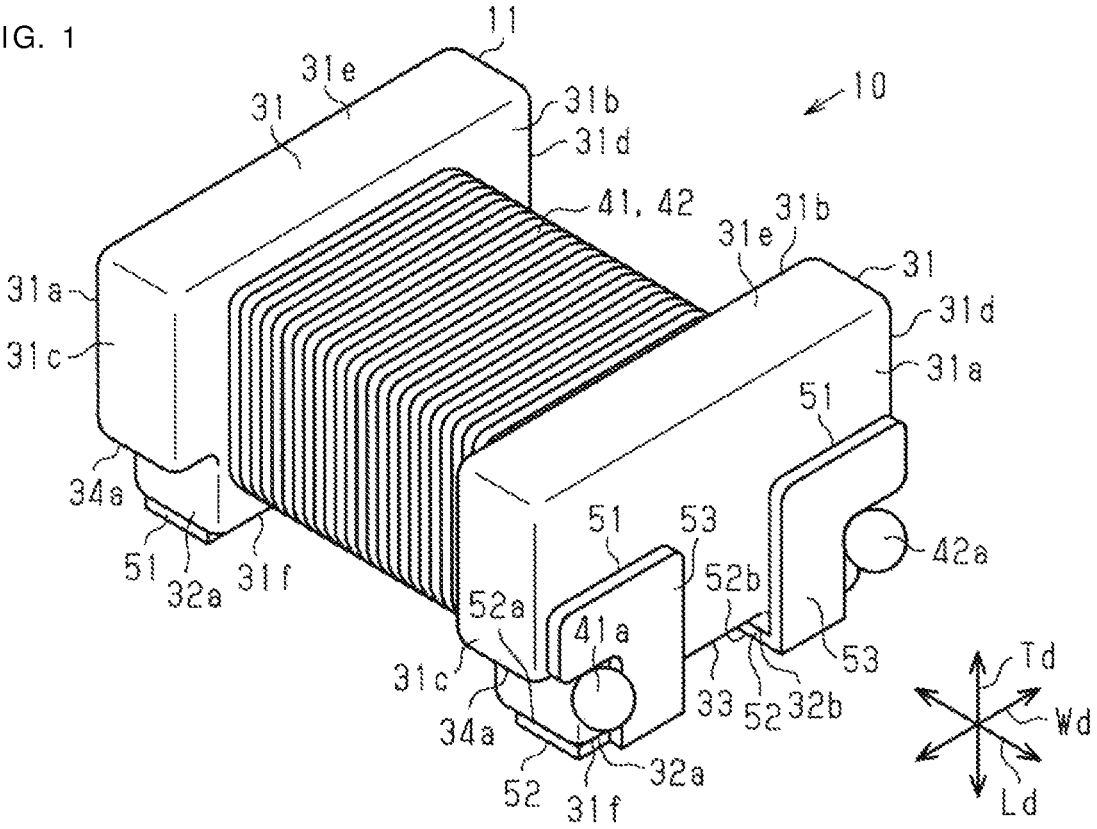
FIG. 1 is a perspective view of a coil component according to an embodiment.

As illustrated in FIG. 1, one example of a coil component 10 may be a common-mode choke coil. The coil component 10 includes a drum core 11, first and second wires 41 and 42 wound around the drum core 11, and metal terminals 51 attached to the drum core 11.

Figure 2:
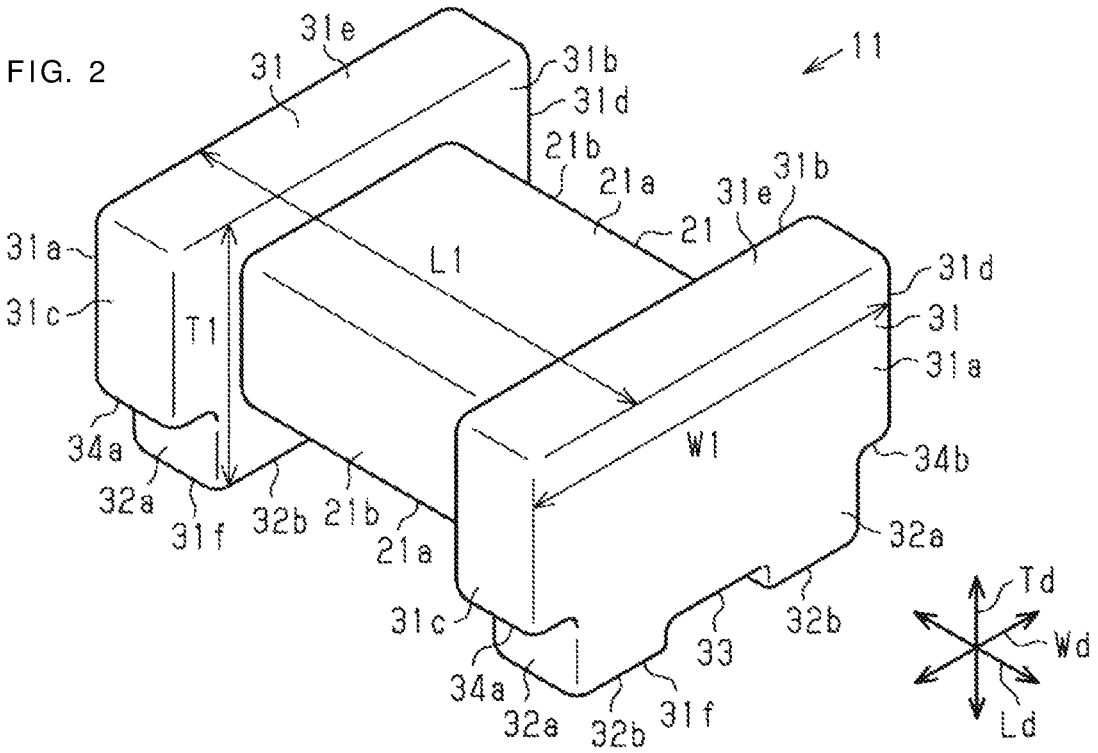
FIG. 2 is a perspective view of a core according to the present embodiment.

As illustrated in FIG. 2, the drum core 11 includes a winding core portion 21 having a substantially rectangular parallelepiped shape and a pair of flange portions 31 on opposite end portions of the winding core portion 21. The winding core portion 21 and the pair of flange portions 31 are integral with each other.

Here, in the present specification, as illustrated in FIGS. 1 and 2, a direction in which the pair of flange portions 31 are arranged (aligned) is defined as "longitudinal direction Ld," a direction that is substantially perpendicular to the "longitudinal direction Ld" and that is the vertical direction in FIGS. 1 and 2 is defined as "height direction (thickness direction) Td," and a direction substantially perpendicular to both the "longitudinal direction Ld" and "height direction Td" is defined as "width direction Wd."

The drum core 11 in the present embodiment may be made of a magnetic material, such as Ni—Cu—Zn ferrite. The drum core 11 may be made of magnetic materials other than Ni—Cu—Zn ferrite.

As illustrated in FIGS. 1 and 2, the first and second wires 41 and 42 are wound around the winding core portion 21. The winding core portion 21 may have a substantially rectangular parallelepiped shape extending along the longitudinal direction Ld. The central axis of the winding core portion 21 extends substantially in parallel with the longitudinal direction Ld. The winding core portion 21 includes a pair of principal surfaces 21*a* opposed to each other in the height direction Td and a pair of side surfaces 21*b* opposed to each other in the width direction Wd.

In the present specification, "substantially rectangular parallelepiped shapes" include substantially rectangular parallelepiped shapes having corner or edge portions beveled (chamfered), substantially rectangular parallelepiped shapes having corner or edge portions rounded as needed, and substantially rectangular parallelepiped shapes having corner or edge portions depressed. The principal surfaces and side surfaces may have projections and depressions in part or in entirety.

As illustrated in FIGS. 1 and 2, each of the pair of flange portions 31 may have a substantially rectangular parallelepiped shape short in the longitudinal direction Ld. The flange portion 31 protrudes toward the height direction Td and width direction Wd such that it extends out around the winding core portion 21. Specifically, the plane shape of the flange portion 31 as seen from the longitudinal direction Ld extends out in the height direction Td and width direction Wd with respect to the winding core portion 21.

The flange portion 31 includes a pair of principal surfaces 31*a* and 31*b* opposed to each other in the longitudinal direction Ld, a pair of side surfaces 31*c* and 31*d* opposed to each other in the width direction Wd, and a pair of side surfaces 31*e* and 31*f* opposed to each other in the height direction Td. The principal surface 31*a* in the flange portion 31 faces a side opposite to the winding core portion 21 in the longitudinal direction Ld (outer side portion of the drum core 11 in the longitudinal direction Ld). That is, the principal surface 31*a* in each flange portion corresponds to an end surface of the flange portion 31 (drum core 11). The principal surface 31*b* in the flange portion 31 faces a side where the winding core portion 21 is positioned (inner side portion of the drum core 11 in the longitudinal direction Ld). That is, the principal surfaces 31*b* in the flange portions 31 correspond to opposed surfaces, which are opposed to each other.

Each of the flange portions 31 includes two separated projections 32*a* projecting toward a mounting substrate (not illustrated), a central recessed portion 33 forming a gap between the two projections 32*a*, and external recessed portions 34*a* and 34*b* contiguous to the projections 32*a* on a side opposite to the central recessed portion 33, on the side where the side surface 31*f* to be mounted on the mounting substrate is positioned. Each of the projections 32*a* extends beyond the central recessed portion 33 and the external recessed portions 34*a* and 34*b* in the height direction Td. The projection 32*a* has a projecting surface 32*b* in its leading end. In a state where the coil component 10 is mounted on the mounting substrate, the projecting surface 32*b* faces the mounting substrate. In the present embodiment, the distance from the projecting surface 32*b* of the projection 32*a* to the principal surface 21*a* of the winding core portion 21 is set at approximately 0.1 mm to approximately 0.5 mm.

The dimension L1 of the length of the drum core 11 having the above-described configuration along the longitudinal direction Ld is set in the range of approximately 1.2 mm to approximately 4.5 mm. The dimension T1 of the height of the drum core 11 along the height direction Td (dimension of the height of the flange portion 31 along the height direction Td) is set in the range of approximately 0.5 mm to approximately 2.1 mm. The dimension W1 of the width of the drum core 11 along the width direction Wd (dimension of the width of the flange portion 31 along the width direction Wd) is set in the range of about 1.0 mm to about 3.2 mm.

The first and second wires 41 and 42 are coated electric wires, are wound around the winding core portion 21 in the same winding direction, and constitute a coil conductor. As one example of each of the first and second wires 41 and 42, a coated electric wire with a dimeter in the range of approximately 15 μm to approximately 80 μm can be used. In the present embodiment, a coated electric wire with a dimeter of approximately 15 μm is used. The first and second wires 41 and 42 are wound around the winding core portion 21 with the same number of turns. As one example of each of the first and second wires 41 and 42, a wire containing copper, such as a wire made of an alloy of copper and nickel can be used. The coating of the first and second wires 41 and 42 can be made of a resin material, such as imide-modified polyurethane. The opposite end portions of the first and second wires 41 and 42 are arranged in the vicinity of the four external recessed portions 34*a* and 34*b* in total in a one-to-one relationship and form connection portions 41*a* and 42*a* electrically connected to the metal terminals 51, which are described later. By welding the opposite end portions of the wires 41 and 42 to the metal terminals 51, the connection portions 41*a* and 42*a* and part of the metal terminals 51 form welding balls. The method of connecting the first and second wires 41 and 42 and the metal terminals 51 is not limited to welding, and another example of that method may be thermocompression bonding using a heater chip.

One pair of the metal terminals 51 are disposed on the projections 32*a* of one of the flange portions 31, respectively. Similarly, another pair of the metal terminals 51 are disposed on the projections 32*a* of the other flange portion 31, respectively. That is, the four metal terminals 51 in total are disposed on the drum core 11. The metal terminals 51 in each pair are symmetrical with each other with respect to a line passing through the center of the winding core portion 21 in the width direction Wd. The metal terminals 51 are electrically connected to the end portions of the first and second wires 41 and 42.

Each of the metal terminals 51 includes a mounting portion 52 and an end surface portion 53, whose shapes are planar. The metal terminal 51 is formed by die-cutting a single planar metal plate (copper plate) and bending it. The metal terminal 51 and the metal plate forming the metal terminal 51 have a Young's modulus set in the range of about 100 GPa to about 200 GPa. The metal terminal 51 and the metal plate forming the metal terminal 51 may preferably have a thickness not less than about 50 μm and not more than about 150 μm (i.e., from about 50 μm to about 150 μm).

Figure 3:
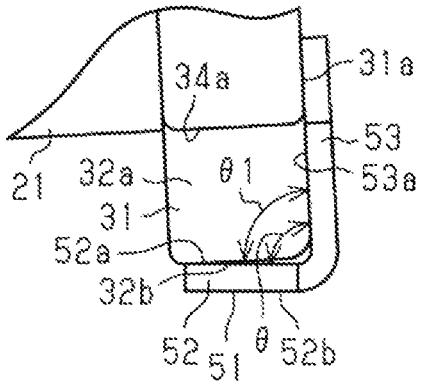
FIG. 3 is a side view of a metal terminal according to the present embodiment.

The mounting portion 52 in the metal terminal 51 is disposed such that its upper surface 52*a* faces the projecting surface 32*b* of the flange portion 31 and is in contact with part of the projecting surface 32*b*. As illustrated in FIG. 3, the mounting portion 52 in the metal terminal 51 has a lower surface 52*b*, and the lower surface 52*b* is supposed to be connected to a mounting substrate (not illustrated). The lower surface 52*b* may be plated with, for example, nickel and tin. A nickel layer can reduce the elution of the metal terminal to solder at the time of being mounted on the mounting substrate. A tin layer can enhance the solder wettability and can improve the connectivity of the wires 41 and 42 to the metal terminals 51. The mounting portion 52 is in contact with the projecting surface 32*b*, but is not joined thereto with an adhesive or the like. That is, the connection state of the mounting portion 52 and projecting surface 32*b* may not necessarily be maintained.

The end surface portion 53 is continuous and integral with the end portion of the mounting portion 52. More specifically, when the metal terminal 51 is seen from the width direction Wd, it is substantially L shaped. The end surface portion 53 has an opposed surface 53*a* (see FIG. 3) opposed to the principal surface 31*a* as an end surface of the flange portion 31, and the opposed surface 53*a* is joined thereto with an adhesive. The "joined" used in the present embodiment is used as a state where the connection state of two members is maintained by another member, such as an adhesive. The adhesive in the present embodiment may preferably have viscosity and thixotropy. These properties can suppress the outflow of the adhesive. Here, unlike the lower surface 52*b* of the mounting portion 52, the opposed surface 53*a* of the end surface portion 53 is not covered with a nickel layer or tin layer. This enables the principal surface 31*a* of the flange portion 31 and the end surface portion 53 (opposed surface 53*a*) in the metal terminal 51 to be satisfactorily joined with the adhesive.

As illustrated in FIG. 3, the metal terminal 51 is configured such that the angle θ between the mounting portion 52 and end surface portion 53 is at or above about 85 degrees and is below about 90 degrees. In other words, the angle θ between the mounting portion 52 and end surface portion 53 is smaller than the angle θ1 between the principal surface 31*a* of the flange portion 31 and projecting surface 32*b* of the flange portion 31 (=substantially 90 degrees) by not more than about 5 degrees. This is because even if the angle θ of the metal terminal 51 is not uniform due to manufacturing variations, the end surface portion 53 in the metal terminal 51 and the principal surface 31*a* of the flange portion 31 can be sufficiently joined between their surfaces and joining to the flange portion 31 with an adhesive can be enhanced.

The percentage of detachment of the metal terminals 51 in the coil component 10 from the drum core 11 (flange portion 31) on impact was determined as described below. The coil component 10 was mounted on a mounting substrate by soldering, they were fixed inside a casing in which all surfaces are covered with plates, a drop test was conducted by causing the mounting substrate in the state where its surface to which the coil component 10 was attached faced downward to drop from a height of substantially 2 meters.

The test was conducted 10 times for each pattern (each angle) of seven patterns of about 95 degrees, about 93 degrees, about 90 degrees, about 87 degrees, about 85 degrees, about 83 degrees, and about 80 degrees for the angle θ in the metal terminal 51, and the percentages of detachment were measured.

TABLE 1

| Angle θ | Percentage of Detachment |
|---|---|
| About 95 Deg. | About 70% |
| About 93 Deg. | About 30% |
| About 90 Deg. | About 0% |
| About 87 Deg. | About 0% |
| About 85 Deg. | About 0% |
| About 83 Deg. | About 20% |
| About 80 Deg. | About 50% |

As indicated in Table 1, the percentages of detachment for about 90 degrees, about 87 degrees, and about 85 degrees were about 0%, and the percentages of detachment for about 95 degrees, about 93 degrees, about 83 degrees, and about 80 degrees were not less than about 20%.

This experimental example reveals that when the angle θ in the metal terminal 51 is in the range of about 90 degrees to about 85 degrees, the percentage of detachment can be low. As the miniaturization of the coil component 10 advances, the miniaturization of the metal terminal 51 inevitably advances, and thus even when manufacturing variations described above are small, the joint portion tends to have a problem. Therefore, the coil component 10 may preferably be manufactured such that the angle θ in the metal terminal 51 is around about 87 degrees.

Actions of the above-described coil component 10 are described next.

In the coil component 10 according to the present embodiment, when signals of opposite phase, such as differential mode signals, are input into the first and second wires 41 and 42, magnetic fluxes produced by the first and second wires 41 and 42 cancel each other out, no impedance occurs, and the differential signals pass. In contrast, when signals of the same phase, such as common mode signals, are input into the first and second wires 41 and 42, magnetic fluxes produced by the first and second wires 41 and 42 strengthen each other, high impedance occurs, and passage of the common mode signals is hindered.

As described above, the present embodiment can provide advantages below.

(1) The angle θ between the mounting portion 52 and end surface portion 53 in the metal terminal 51 is smaller than the angle θ1 between the projecting surface 32*b* and principal surface 31*a* of the flange portion 31. For example, if the angle θ between the mounting portion 52 and end surface portion 53 in the metal terminal 51 is larger than the angle θ1 between the projecting surface 32*b* and principal surface 31*a* of the flange portion 31 (is an obtuse angle), the end surface portion 53 in the metal terminal 51 and the principal surface 31*a* of the flange portion 31 are partly separated from each other, and this may result in a situation where the end surface portion 53 in the metal terminal 51 and the principal surface 31*a* of the flange portion 31 are not sufficiently joined between their surfaces. To address this issue, the angle θ between the mounting portion 52 and end surface portion 53 in the metal terminal 51 is smaller than the angle θ1 between the projecting surface 32*b* and principal surface 31*a* of the flange portion 31. With this configuration, the situation where the end surface portion 53 in the metal terminal 51 and the principal surface 31*a* of the flange portion 31 are not sufficiently joined between their surfaces can be suppressed, and detachment of the metal terminal 51 from the drum core 11 (flange portion 31) can be suppressed.

(2) When the angle θ1 between the projecting surface 32*b* and principal surface 31*a* is about 90 degrees, the angle θ between the mounting portion 52 and end surface portion 53 satisfies the relationship 85 degrees≤θ<90 degrees. With this configuration, the situation where the end surface portion 53 in the metal terminal 51 and the principal surface 31*a* of the flange portion 31 are not sufficiently joined between their surfaces can be suppressed, and detachment of the metal terminal 51 from the drum core 11 (flange portion 31) can be suppressed.

(3) The metal terminal 51 is joined at the principal surface 31*a* (end surface) of the flange portion 31, that is, it is not joined to the projecting surface 32*b* of the flange portion 31 with an adhesive or the like. Here, under environments where vibrations are applied to the coil component 10, the vibrations are transmitted from a mounting substrate. That is, because the projecting surface 32*b* of the flange portion 31 is not joined to the metal terminal 51 with an adhesive or the like, transmission of vibrations directly from the projecting surface 32*b* can be suppressed. Because the metal terminal 51 and flange portion 31 are joined at the principal surface 31*a*, which is remote from the projecting surface 32*b*, the vibrations attenuate, and detachment of the metal terminal 51 from the drum core 11 can be suppressed.

(4) The nickel plating can suppress corrosion of the metal terminal 51 and can also suppress diffusion of the metal terminal 51 (copper) by tin. The tin plating can enhance the solder wettability at the time of soldering the metal terminal 51 and the mounting substrate.

(5) The thickness of the plate forming the metal terminal 51 set at not less than about 50 μm can enable the metal terminal 51 to have a satisfactory strength, and the thickness set at not more than about 150 μm can contribute to improved workability.

(6) The Young's modulus of the plate forming the metal terminal 51 set at not less than about 100 GPa can enable the metal terminal 51 to have a satisfactory strength, and the Young's modulus set at not more than about 200 GPa can enable the metal terminal 51 to have appropriate flexibility.

The above-described embodiment is also applicable to embodiments below.

In the above-described embodiment, the principal surface 31*a* as an end surface and the end surface portion 53 are joined together with an adhesive, and the projecting surface 32*b* and the mounting portion 52 are not joined together with an adhesive or the like. Another configuration in which the projecting surface 32*b* and the mounting portion 52 are joined together with an adhesive or the like may also be adopted. In this case, the joined area at the projecting surface 32*b* may preferably be smaller than the joined area at the principal surface 31*a* (end surface). With this configuration, if expansion and contraction are caused by temperature changes in the mounting substrate, the metal terminal 51 adjacent to the projecting surface 32*b* (upper surface 52*a*) is easily separated from the projecting surface 32*b*, and thus the joined state at the principal surface 31*a* can be maintained. As described in the above embodiment, because the principal surface 31*a* side is remote from the projecting surface 32*b*, the effects of expansion and contraction caused by temperature changes in the mounting substrate can be suppressed, and detachment of the metal terminal 51 from the drum core 11 can be suppressed.

Figure 4:
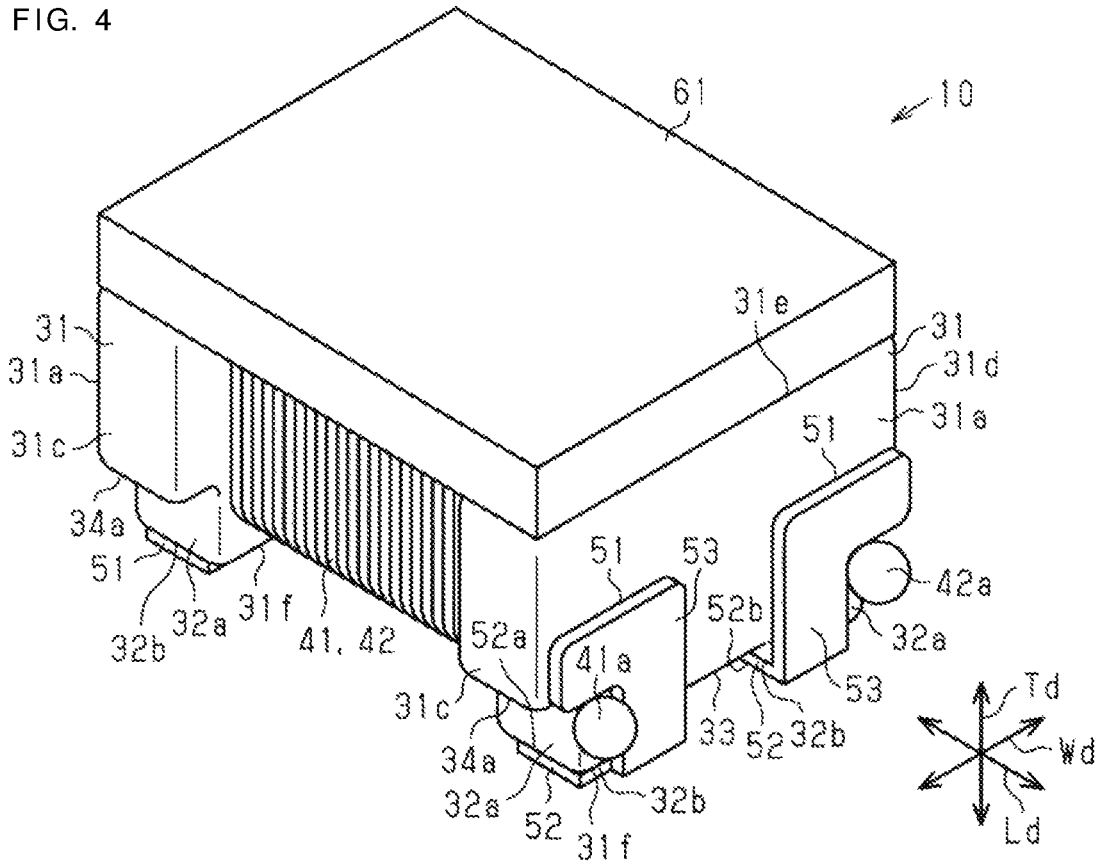
FIG. 4 is a perspective view of a coil component according to a variation.

As illustrated in FIG. 4, a configuration in which a planar core 61 is disposed on the side surface 31*e*, which is opposite to the projecting surface 32*b*, such that the planar core 61 extends across the gap between the pair of flange portions 31 may also be used. In this case, the thickness of the planar core 61 may preferably be in the range of about 0.15 mm to about 0.6 mm. The thickness being not less than about 0.15 mm can provide a satisfactory inductance value, and the thickness being not more than about 0.6 mm can achieve a reduced profile. By making the planar core 61 of, for example, a magnetic material, the magnetic flux density can be increased.

The above-described embodiment uses a common-mode choke coil as the coil component 10. The above-described configuration may also be applied to other types of coils, including a winding-type coil.

The above-described embodiment and variations may be combined.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a core including a winding core portion and a pair of flange portions on opposite ends of the winding core portion;

a metal terminal on each of the pair of flange portions; and a wire wound around the winding core portion and including end portions electrically connected to the metal terminals, wherein each of the flange portions includes a projecting surface that is positioned in a leading end of a projection projecting toward a mounting substrate and that faces the mounting substrate and an end surface that extends in a direction crossing the projecting surface and that faces an opposite side to the winding core portion in a direction in which the pair of flange portions are aligned, each of the metal terminals includes a mounting portion opposed to the projecting surface and an end surface portion opposed to the end surface, and an angle θ between the mounting portion and the end surface portion is smaller than an angle θ1 between the projecting surface and the end surface, each of the metal terminals has a distal edge at a distance away from an edge of the end surface that meets a side surface of the flange portion that is on an opposite side of the flange portion from the projecting surface, the end surface portion extends towards the side surface and an outermost edge of the end surface portion is located inward of the side surface, and a top edge of each of the metal terminals is exposed from the end surface of the flange portion.

2. The coil component according to claim 1, wherein when the angle θ1 between the projecting surface and the end surface is about 90 degrees, the angle θ between the mounting portion and the end surface portion satisfies a relationship 85 degrees≤θ<90 degrees.

3. The coil component according to claim 1, wherein the metal terminal is joined to only the end surface of the flange portion.

4. The coil component according to claim 1, wherein the metal terminal is joined to both the end surface and the projecting surface of the flange portion, and a joined area at the projecting surface is smaller than a joined area at the end surface.

5. The coil component according to claim 1, wherein the metal terminal is formed by bending a single plate containing copper, and the metal terminal includes an opposed surface opposed to the mounting substrate, the opposed surface being covered with a nickel metal film and a tin metal film.

6. The coil component according to claim 1, wherein the metal terminal is made of a plate having a thickness from about 50 μm to about 150 μm.

7. The coil component according to claim 1, wherein the metal terminal is made of a plate having a Young's modulus from about 100 GPa to about 200 GPa.

8. The coil component according to claim 2, wherein the metal terminal is joined to only the end surface of the flange portion.

9. The coil component according to claim 2, wherein the metal terminal is joined to both the end surface and the projecting surface of the flange portion, and a joined area at the projecting surface is smaller than a joined area at the end surface.

10. The coil component according to claim 2, wherein the metal terminal is formed by bending a single plate containing copper, and the metal terminal includes an opposed surface opposed to the mounting substrate, the opposed surface being covered with a nickel metal film and a tin metal film.

11. The coil component according to claim 3, wherein the metal terminal is formed by bending a single plate containing copper, and the metal terminal includes an opposed surface opposed to the mounting substrate, the opposed surface being covered with a nickel metal film and a tin metal film.

12. The coil component according to claim 4, wherein the metal terminal is formed by bending a single plate containing copper, and the metal terminal includes an opposed surface opposed to the mounting substrate, the opposed surface being covered with a nickel metal film and a tin metal film.

13. The coil component according to claim 2, wherein the metal terminal is made of a plate having a thickness from about 50 μm to about 150 μm.

14. The coil component according to claim 3, wherein the metal terminal is made of a plate having a thickness from about 50 μm to about 150 μm.

15. The coil component according to claim 4, wherein the metal terminal is made of a plate having a thickness from about 50 μm to about 150 μm.

16. The coil component according to claim 5, wherein the metal terminal is made of a plate having a thickness from about 50 μm to about 150 μm.

17. The coil component according to claim 2, wherein the metal terminal is made of a plate having a Young's modulus from about 100 GPa to about 200 GPa.

18. The coil component according to claim 3, wherein the metal terminal is made of a plate having a Young's modulus from about 100 GPa to about 200 GPa.

19. The coil component according to claim 4, wherein the metal terminal is made of a plate having a Young's modulus from about 100 GPa to about 200 GPa.

20. The coil component according to claim 5, wherein the metal terminal is made of a plate having a Young's modulus from about 100 GPa to about 200 GPa.

21. A coil component comprising:

a core including a winding core portion and a pair of flange portions on opposite ends of the winding core portion;

a metal terminal on each of the pair of flange portions; and a wire wound around the winding core portion and including end portions electrically connected to the metal terminals, wherein each of the flange portions includes a projecting surface that is positioned in a leading end of a projection projecting toward a mounting substrate and that faces the mounting substrate and an end surface that extends in a direction crossing the projecting surface and that faces an opposite side to the winding core portion in a direction in which the pair of flange portions are aligned, each of the metal terminals includes a mounting portion opposed to the projecting surface and an end surface portion opposed to the end surface, and an angle θ between the mounting portion and the end surface portion is smaller than an angle θ1 between the projecting surface and the end surface, each of the metal terminals has a distal edge at a distance away from an edge of the end surface that meets a side surface of the flange portion that is on an opposite side of the flange portion from the projecting surface, and in a longitudinal direction of the coil component, the end surface portion is located on an outermost surface of the coil component.

22. A coil component comprising:

a core including a winding core portion and a pair of flange portions on opposite ends of the winding core portion;

a metal terminal on each of the pair of flange portions; and a wire wound around the winding core portion and including end portions electrically connected to the metal terminals, wherein each of the flange portions includes a projecting surface that is positioned in a leading end of a projection projecting toward a mounting substrate and that faces the mounting substrate and an end surface that extends in a direction crossing the projecting surface and that faces an opposite side to the winding core portion in a direction in which the pair of flange portions are aligned, each of the metal terminals includes a mounting portion opposed to the projecting surface and an end surface portion opposed to the end surface, and an angle θ between the mounting portion and the end surface portion is smaller than an angle θ1 between the projecting surface and the end surface, each of the metal terminals has a distal edge at a distance away from an edge of the end surface that meets a side surface of the flange portion that is on an opposite side of the flange portion from the projecting surface, and the end surface portion extends towards the side surface and an outermost edge of the end surface portion is located inward of the side surface, and edges of the metal terminals that face each are not obstructed by a portion of the flange portion.

* * * * *